US005636930A

United States Patent [19]

Holloway

[11] Patent Number: 5,636,930

[45] Date of Patent: Jun. 10, 1997

[54] COSMETIC DISPENSER WITH CAM LOCKING FEATURE

[75] Inventor: Thomas F. Holloway, Southbury, Conn.

[73] Assignee: Risdon Corporation, Naugatuck, Conn.

[21] Appl. No.: 365,016

[22] Filed: Dec. 28, 1994

[51] Int. Cl.[6] ..... A45D 40/06; A45D 40/12

[52] U.S. Cl. ..... 401/78; 401/74

[58] Field of Search ..... 401/78, 74

[56] References Cited

U.S. PATENT DOCUMENTS

| | | | |
|---|---|---|---|
| 1,695,625 | 12/1928 | Wild | 401/74 |
| 2,630,215 | 3/1953 | Lynn | 401/78 |
| 2,913,103 | 11/1959 | Isele | 206/56 |
| 3,438,714 | 4/1969 | Seaver | 401/74 |
| 3,515,493 | 6/1970 | Gruska | 401/74 |
| 3,620,632 | 11/1971 | Gruska | 401/78 |
| 3,623,822 | 11/1971 | Davidson | 401/78 |
| 4,750,501 | 6/1988 | Ackermann et al. | 132/79 C |
| 4,812,066 | 3/1989 | Gueret | 401/78 |
| 4,984,919 | 1/1991 | Hultgren | 401/74 X |
| 5,186,560 | 2/1993 | Holloway | 401/78 |
| 5,186,561 | 2/1993 | Ackermann et al. | 401/78 |
| 5,324,126 | 6/1994 | Holloway | 401/78 |

FOREIGN PATENT DOCUMENTS

| | | | |
|---|---|---|---|
| 0554974 | 8/1993 | European Pat. Off. . | |
| 933542 | 4/1948 | France | 401/78 |
| 1005782 | 4/1952 | France | 401/78 |
| 520570 | 4/1940 | United Kingdom | 401/78 |

*Primary Examiner*—Steven A. Bratlie

*Attorney, Agent, or Firm*—St. Onge Steward Johnston & Reens LLC

[57] ABSTRACT

A cosmetic preparation dispenser is provided that has a helical cam track with a horizontal step at its lower end and a longitudinal innerbody track that terminates adjacent the horizontal step. A cam follower lug of an elevator cup will track into and be trapped by and between the horizontal step and the lower end of the longitudinal track. This locks the innerbody to the cam sleeve to prevent longitudinal sliding of the innerbody relative to the cam sleeve when, e.g., a lipstick cover is removed in an assembled cosmetic container, which cover removal might leave an undesirable gap between the decorative shells surrounding the innerbody and cam sleeve.

9 Claims, 2 Drawing Sheets

COSMETIC DISPENSER WITH CAM LOCKING FEATURE

FIELD OF THE INVENTION

The present invention relates to the field of cosmetic and lipstick dispensers, and particularly to a dispenser having a pomade anti-back-off feature.

BACKGROUND OF THE INVENTION

Conventional propel/repel lipstick dispensers typically have an outer helical cam track sleeve and a longitudinal track innerbody rotatable inside the cam sleeve to axially propel and retract an elevator cup with a lug or lugs that track in the cam track and in the longitudinal track, It is known in the art to provide cosmetic dispensers such as lipstick cases with a desirable frictional drag "feel" to the consumer operator when the dispenser is operated to extend or retract the cosmetic stick. It is desirable in providing such a feel that the swivel torque needed to rotate the components to dispense the lipstick remain nearly constant, regardless of whether the dispenser is nearly full or exhausted of the cosmetic. The swivel torque should be significant enough to impart a firm feel to the dispenser. Looseness, uneven drag, or inconsistency of torque can be interpreted by the consumer as indicating an inferior quality product.

Recently, in U.S. Pat. No. 5,324,126 to Holloway and Ackermann issued Jun. 28, 1994, a lipstick dispenser is proposed that provides desirable swivel drag while also preventing pomade back-off. The disclosure of U.S. Pat. No. 5,324,126 is hereby incorporated by reference. This dispenser is very effective in eliminating problems of pomade back-off.

Pomade back-off occurs when a consumer is using a lipstick dispenser and the force of applying the lipstick to the consumer's lips pushes the pomade and elevator cup down the helical and longitudinal tracks of the dispenser. Pomade back-off is generally prevented when the pomade is fully extended by providing horizontal locking tracks at the upper end of the inner body longitudinal tracks. However, if the consumer does not fully extend the pomade (as can often occur when a new lipstick is being used), the locking tracks are unavailing since the elevator cup is not extended sufficiently to engage in the locking tracks. Pomade back-off is most noticeable in single turn dispensers (in which the cam tracks extend around 360 degrees of the dispenser) which have relatively higher cam angles, so that pressure on the elevator cup tends to move the cup and pomade back down the cam and innerbody tracks. This problem is less acute in higher turn dispensers such as double or triple turn dispensers. However, for the convenience of a consumer, a single turn dispenser is preferable as it is easier and more elegant to use.

The described dispenser effectively eliminates problems of pomade back-off. However, it has been found in a few combinations that the dispenser's cam sleeve and surrounding decorative A-shell can be moved upwardly on the innerbody sufficiently to leave a discernable gap between the decorative A-shell and the decorative base surrounding the lower end of the innerbody. This is aesthetically unpleasing. The problem arises particularly when a cap is used that friction fits onto the decorative A-shell. The cap ribs engage and push the A-shell downwardly until it stops against a base shoulder. Then, when the consumer removes the cap, the frictional engagement of the cap ribs will cause the decorative A-shell and cam sleeve to also be pulled upwardly, creating the undesirable gap between the A-shell and the base shoulder.

SUMMARY OF THE INVENTION

It is an object of the invention to provide an improved cosmetic preparation dispenser having a mechanism which reduces pomade back-off that can occur when a consumer applies pressure to a cosmetic pomade. It is an object of the present invention that the dispenser has an ability to lock the cam sleeve to prevent it from sliding relative to the innerbody when the elevator cup is in the retracted position, and to therefore eliminate the possibility of an unaesthetic gap between an A-shell and base surrounding the cam sleeve and innerbody.

In accordance with the present invention, a cosmetic dispenser includes a cam sleeve, innerbody and elevator cup, with a molded resilient flex tab on the innerbody that presses against the cam sleeve for creating a swivel drag between the dispenser's cam sleeve and innerbody. A bevelled shoulder section is provided around the outer walls of the base of the innerbody. A lower skirt of the cam sleeve rides on the bevelled base. This combination reduces pomade back-off because force on the pomade is translated to the interface of the lower skirt of the cam sleeve and the bevelled shoulder, causing the cam sleeve to frictionally lock in place against the bevelled shoulder of the innerbody. This prevents rotation of the innerbody relative to the cam sleeve and substantially eliminates pomade back-off.

The cam sleeve has one or two cam sleeve tracks. A step is provided at the lower end of at least one of the cam sleeve tracks. The step may comprise a widening of the track or a lateral track segment. The step receives a lug of the elevator cup when the cup is fully retracted at the bottom of the longitudinal track in the innerbody. The lug, being seated at the bottom of the longitudinal track of the innerbody, is prevented from further downward travel. The lug is prevented from upward travel by the upper wall of the step. The lug and elevator cup therefore serve to lock the cam sleeve in place relative to the innerbody. This prevents separation of the surrounding A-shell from the decorative base when a cap is removed from the A-shell.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 2:
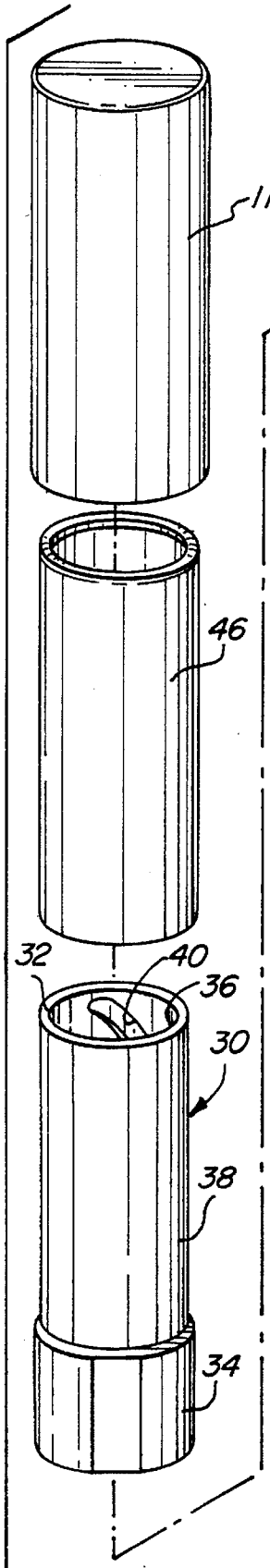
FIG. 2 is an exploded perspective view of the dispenser of FIG. 1.
Figure 2:
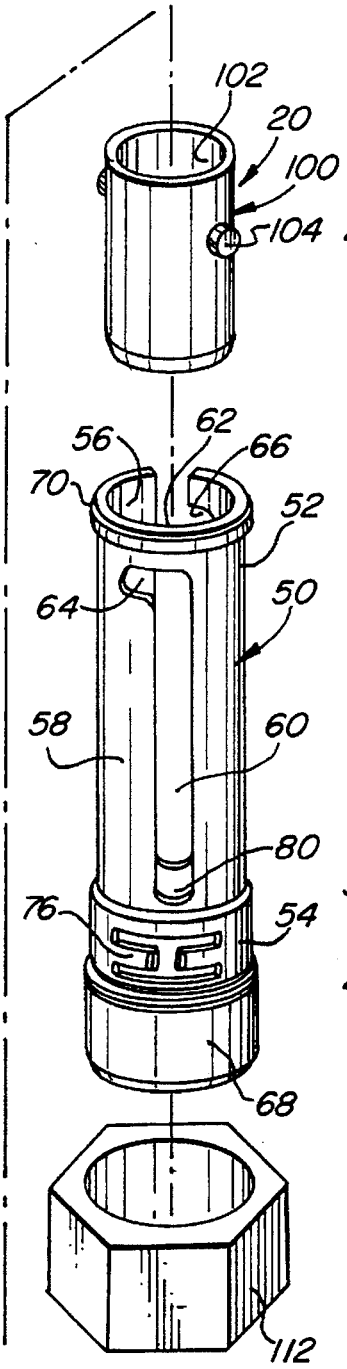

Referring now to FIGS. 1–5, where like elements are identified by like numbers in the drawings, an improved cosmetic dispenser with anti-back-off features and a cam sleeve/innerbody lock is shown generally at 20. Dispenser 20 comprises a cam sleeve 30, an innerbody 50, and an elevator cup 100.

Figure 1:
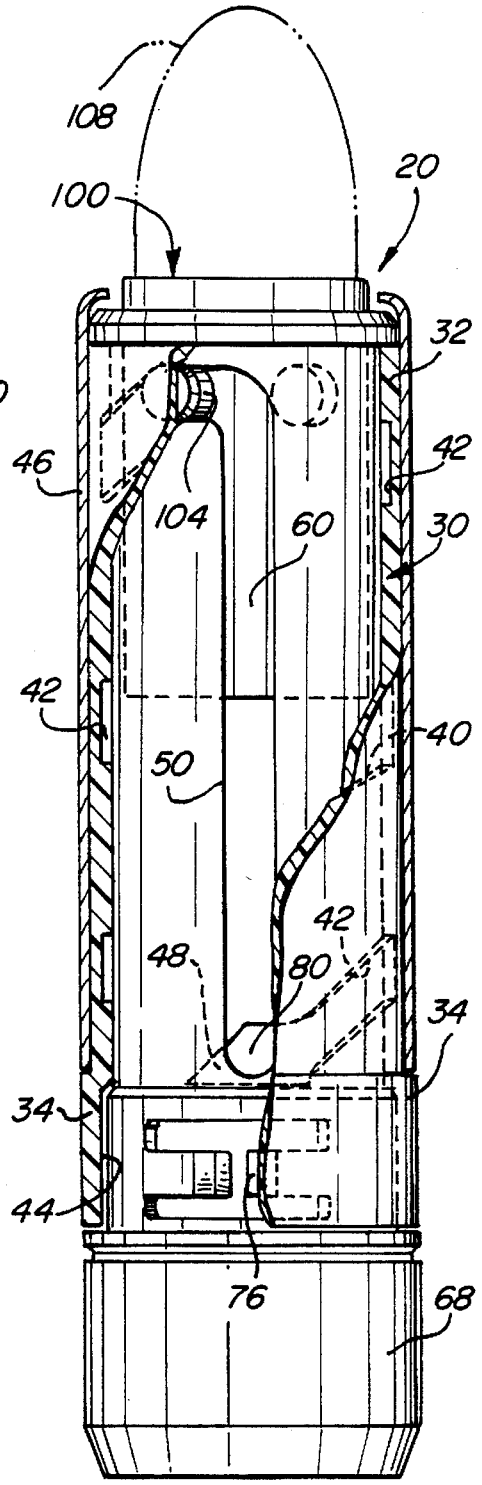
FIG. 1 is a side elevation view with a partial cutaway of an embodiment of a cosmetic dispenser in accordance with the invention.
Figure 3:
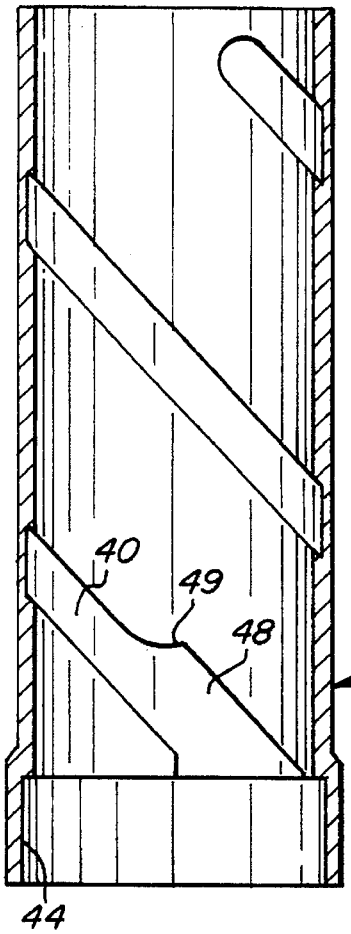
FIG. 3 is a cross-sectional view of a cam sleeve for use in accordance with the invention.
Figure 5:
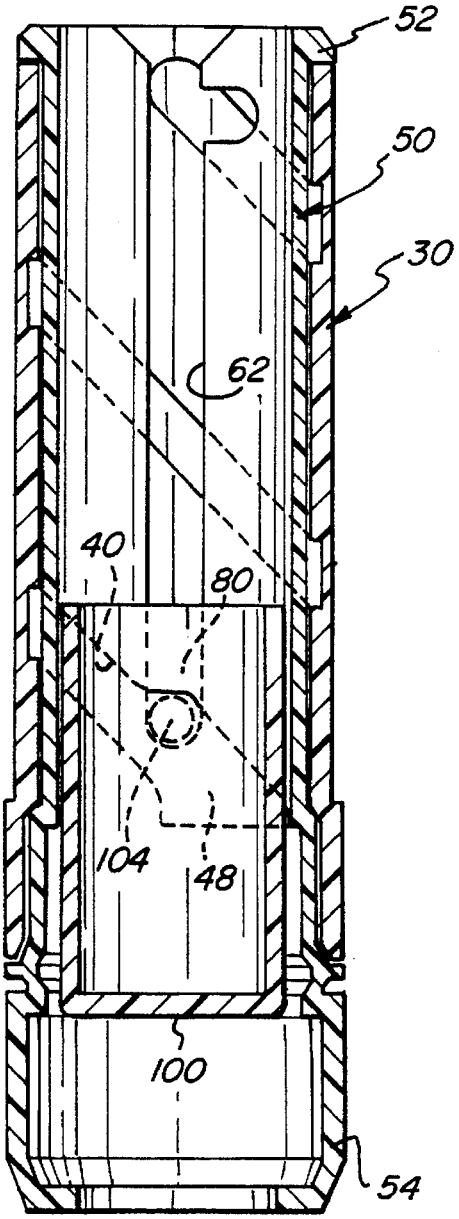
FIG. 5 is a cross-sectional side view of the dispenser of FIG. 1 showing locking of the cam sleeve when the elevator cup is retracted.

Cam sleeve 30 is rigid and tubular and has an upper end 32 and a lower base 34. Cam sleeve 30 has an inner wall 36 and an outer wall 38. At least one and preferably two internal helical tracks 40 and 42 are formed on the inner wall 36. Helical tracks 40 and 42 are located 180 degrees apart and extend along a substantial length of the inner wall 36 of the cam sleeve 30. At least one, and preferably both of helical tracks 40 and 42 are provided with a step 48 at their lower ends. Step 48 may comprise a widening of the helical tracks 40, 42, as shown in FIG. 5, or it may be considered, and may comprise a lateral track segment extending horizontally leftwardly from the helical tracks 40, 42, as shown in FIG. 1. The step 48 is located such that it is adjacent the lower end 80 of innerbody longitudinal tracks 60 and 62 when the cam sleeve 30 and innerbody 50 are rotated to fully retract the elevator cup 100 located therein, as shown in FIG. 5. As can be seen, the lower end 80 and step 48 are on about the same level, however they are vertically separated inasmuch as the lowest part of the lower end 80 is separated from the upper wall 49 of step 48 by a distance sufficient to receive and trap the cam follower lugs 104 as set forth hereafter.

Preferably, each helical track 40 and 42 provides one 360 degree revolution in the inner wall 36 of cam sleeve 30. Cam sleeve 30 has a smooth inner wall 44 at its base 34. An ornamental outer shell 46 such as a brass tube may be fitted over the outer wall 38 of the cam sleeve for decoration.

Innerbody 50 is also tubular and has an upper end 52 and a lower end 54. Innerbody 50 has an inner wall 56 and an outer wall 58. Innerbody 50 is fitted into the cam sleeve 30 and has at least one and preferably two longitudinal tracks 60 and 62 which extend along the axial length of the innerbody 50 and which extend through the walls 56 and 58 of the innerbody 50 along a substantial length of the innerbody 50. Preferably, one of the longitudinal tracks 60 extends to the upper end 52 of the innerbody 50 so that it is open at its upper end. The other longitudinal track 62 preferably does not so extend so that it is closed at its upper end. This permits easy assembly of the elevator cup 100 into innerbody 50.

The longitudinal tracks 60 and 62 preferably have at their upper ends upper lateral track segments 64 and 66 respectively which preferably extend perpendicularly from the longitudinal tracks 60 and 62. The upper lateral track segments 64 and 66 assist the elevator cup 100 to be locked in an extended position for application of a cosmetic.

The innerbody 50 is interlocked with the cam sleeve 30 so that rotation or application of a swivel torque to the cam sleeve 30 relative to innerbody 50 can be accomplished by gripping an extended cylindrical portion 68 on innerbody 50 with one hand and cam sleeve 30 with the other hand to raise or lower elevator cup 100. The cam sleeve 30 and innerbody 50 are preferably secured together by a retaining lip 70 on the upper end 52 of innerbody 50 that retains the upper end 32 of cam sleeve 30 in place on innerbody 50. The knob 68 of innerbody 50 has a larger diameter than the lower end 34 of cam sleeve 30 and thereby holds the cam sleeve lower end 34 in place.

The elevator cup 100 is generally cylindrical and has a chamber 102 for containing a cosmetic preparation such as lipstick pomade 108. The cup 100 is fitted into the innerbody 50. Cup 100 has at least one and preferably two cam follower lugs 104 for seating in and following in the longitudinal tracks 60 and 62 of the innerbody 50 and the helical tracks 40 and 42 of the cam sleeve 30. The lugs 104 are located 180 degrees apart and have a sufficient length to extend through the longitudinal tracks 60 and 62 to engage the helical tracks 40 and 42. Cup 100 is movable in an axial path in a conventional manner by relative rotation of the innerbody 50 and cam sleeve 30 by virtue of the lugs 104 seating in the helical tracks 40 and 42 of cam sleeve 30 and the longitudinal tracks 60 and 62 of innerbody 50. The relative rotation of the cam sleeve 30 and innerbody 50 causes the cup 100 to move axially to propel the elevator cup 100 to an extended position, and relative rotation in the opposite direction causes the elevator cup 100 to retract to a retracted position. In the preferred embodiment, the helical tracks 40 and 42 are right hand threads in the cam sleeve 30 and have a thread pitch of about 30 degrees so that each makes one complete revolution as the cup 100 traverses the length of the dispenser 20. This is desirable as only a single turn is needed to fully activate the dispenser 20 or to fully retract the dispenser.

Resilient flex tab or tabs 76 are formed with and attached by tab root to the lower end 54 of the innerbody 50. Tabs 76 are at least partially cut away from the innerbody 50 to enhance resilience. The flex tabs 76 may have various embodiments as described in the art, and have sufficient resilience to be flexed radially inwardly.

The flex tabs 76 provide a frictional braking effect against the inner wall 44 of the base 34 of cam sleeve 30, to give the desired drag and constant swivel torque. Because the frictional engagement takes place around a fixed annular wall in a circumferential path, an even drag is provided that is relatively insensitive to the position of the elevator cup along the innerbody.

Figure 4:
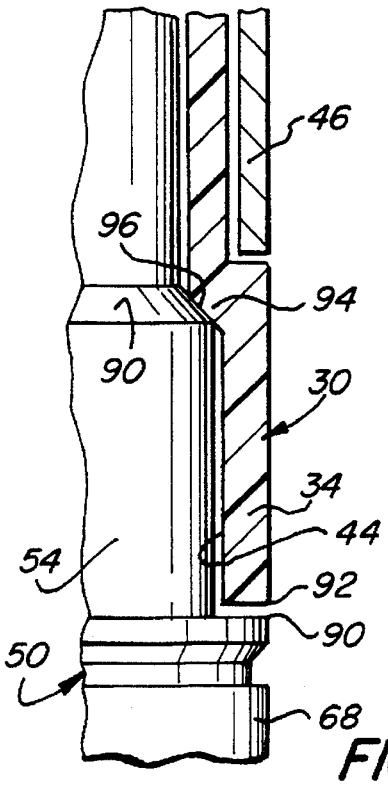
FIG. 4 is a cross-section side elevation view of a bevelled shoulder of an innerbody engaging a cam sleeve in an embodiment of the invention.

Referring to FIG. 4, the tabs 76 provide an outwardly directed force on one side of the inner wall 44 of cam sleeve 30. This force pulls the cam sleeve 30 towards the side of innerbody 50 containing tab 76. This lateral force is translated, due to the angle of bevelled shoulder 96, into upward motion and force as shoulder 94 rides up shoulder 96. Consequently, the upper edge 32 of cam sleeve 30 is pressed against the retaining lip 70 of innerbody 50. This provides a substantial increase in swivel drag to impart the desired luxurious feel to dispenser 20.

The shoulder 94 is provided on cam sleeve 30 to frictionally engage bevelled shoulder 96 of innerbody 50. When a downward force, such as the pressure of a consumer's lips, is applied to pomade 108, it will be transferred to lugs 104 of elevator cup 100. Lugs 104, being seated in helical tracks 40 and 42, transfer the downward force to the cam sleeve 30. Cam sleeve 30 is thereby moved downwardly slightly until shoulder 94 is jammed against and engages bevelled shoulder 96, effectively preventing rotation of cam sleeve 30 relative to innerbody 50 when the innerbody knob 68 is held stationary. This reduces the ability of the elevator cup to retract and consequently alleviates pomade back-off. Shoulder 94 and bevelled shoulder 96 are located to prevent an overextension of cam sleeve 30 on shoulder 90 which might cause splitting of the lower base 34 of cam sleeve 30.

The innerbody 50 and the cam sleeve 30 are preferably formed by molding from a thermoplastic such as styrene. The flex tab 76 is molded as part of the innerbody 50.

Referring now particularly to FIGS. 1 and 2, an ornamental A-shell such as a brass A-shell 46 will be located over the cam sleeve 30. A cap 110 may be provided to fit over the dispenser cartridge by frictionally fitting onto the A-shell. An ornamental base 112 may be provided to fit into the knob 68 at the base of innerbody 50. The operation of the invention prevents an undesirable separation between the A-shell 46 and base 112 when cap 110 is removed from a retracted lipstick cartridge. The invention operates to prevent longitudinal upward movement of the cam sleeve 30 relative to the innerbody 50 by the engagement of lugs 104 with step 48. In particular, the step 48 receives a lug 104 of the elevator cup 100 when the cup is fully retracted at the bottom of the longitudinal track 60, 62 in the innerbody 50. The lug 104, being seated at the bottom of the longitudinal track 60, 62 of the innerbody 50, is prevented from further downward travel. The lug 104 is prevented from upward travel by the upper wall 49 of the step 48. The lug 104 and elevator cup 100 therefore serve to lock the cam sleeve 30 in place relative to the innerbody 50. This prevents separation of the surrounding A-shell and base when a cap is removed from the A-shell.

In an alternative embodiment, a rightwardly extending lateral track segment may be provided at the lower end 80 of innerbody 50, and the step 48 may be either included or omitted.

The present invention therefore provides a new and useful cosmetic dispenser with a substantially longer lasting frictional swivel drag effect than has been known in prior art dispensers, which is obtained without creating undesirable side effects.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A cosmetic dispenser, comprising:

a tubular cam sleeve having a base, and upper and lower ends, and an inner wall and an outer wall, and an inner shoulder located on said inner wall of said cam sleeve at a position adjacent an upper end of said base, said cam sleeve base being generally unbroken and circular, and said cam sleeve having an internal helical track extending along a substantial length of the inner wall of said cam sleeve, said track having a lower end with a horizontally extending track step;

a tubular innerbody having upper and lower ends, said innerbody being fitted into said tubular cam sleeve and being provided with a longitudinal track extending through the wall of said innerbody along a substantial length of said innerbody, said longitudinal track having a lower end, said longitudinal track lower end terminating adjacent to said horizontally extending track step of said cam sleeve helical track, and having a bevelled shoulder around a lower outer wall thereof located below said lower end of said longitudinal track;

a generally cylindrical elevator cup for containing a cosmetic preparation, fitted into said innerbody and having a cam follower lug extending through said longitudinal track to engage said helical track, whereby retraction of said elevator cup causes said cam follower lug to be received in and trapped by said horizontally extending track step of said cam sleeve together with said longitudinal track lower end of said innerbody to lock said innerbody and cam sleeve together to prevent longitudinal sliding of said innerbody relative to said cam sleeve; and said cam sleeve and innerbody being capable of limited axial movement relative to each other when said cam follower lug is not trapped by said horizontally extending track step of said cam sleeve with said longitudinal track lower end of said innerbody, said cam sleeve being movable by force applied to said elevator cup and transferred from said elevator cup to said cam sleeve through engagement of said cam follower lug in said helical track of said cam sleeve to move said cam sleeve downwardly to cause said cam sleeve inner shoulder to frictionally engage with said innerbody bevelled shoulder to prevent relative rotation of said innerbody and said cam sleeve.

2. A cosmetic dispenser in accordance with claim 1, further comprising a decorative shell surrounding said cam sleeve, and a decorative base surrounding said innerbody lower end.

3. A cosmetic dispenser in accordance with claim 2, further comprising a decorative cover frictionally fit over said cam sleeve decorative shell, and wherein locking of said cam sleeve and said innerbody together permits said cover to be removed from said decorative shell without providing a gap between said decorative shell and decorative base.

4. A cosmetic dispenser, comprising:

a tubular cam sleeve having a base, and upper and lower ends, and an inner wall and an outer wall, and an inner shoulder located on said inner wall of said cam sleeve at a position adjacent an upper end of said base, said cam sleeve base being generally unbroken and circular, and said cam sleeve having two internal helical tracks located 180 degrees apart and extending along a substantial length of the inner wall of said cam sleeve, said tracks having a lower end with a horizontally extending track step;

a tubular innerbody having upper and lower ends, said innerbody being fitted into said tubular cam sleeve and being provided with two longitudinal tracks extending through the wall of said innerbody along a substantial length of said innerbody, said longitudinal tracks having lower ends, said longitudinal track lower ends terminating at a level adjacent to a level of said horizontally extending track steps of said cam sleeve helical tracks, and having a bevelled shoulder around a lower outer wall thereof located below said lower ends of said longitudinal tracks;

a generally cylindrical elevator cup for containing a cosmetic preparation, fitted into said innerbody and having two cam follower lugs located 180 degrees apart and having a sufficient length to extend through said longitudinal tracks to engage said helical tracks, said elevator cup being movable in an axial path by relative rotation of said innerbody and cam sleeve to extend and retract said elevator cup, whereby full retraction of said elevator cup causes said cam follower lugs to be received in and trapped by and between said horizontally extending track steps and said longitudinal track lower ends to lock said innerbody and cam sleeve together to prevent longitudinal sliding of said innerbody relative to said cam sleeve; and said cam sleeve and innerbody being capable of limited axial movement relative to each other when said cam follower lugs are not trapped by said horizontally extending track steps of said cam sleeve with said lower ends of said longitudinal tracks of said innerbody, said cam sleeve being movable by force applied to said elevator cup and transferred from said elevator cup to said cam sleeve through engagement of said cam follower lug in said helical track of said cam sleeve to move said cam sleeve downwardly to cause said cam sleeve inner shoulder to frictionally engage with said innerbody bevelled shoulder to prevent relative rotation of said innerbody and said cam sleeve.

5. A cosmetic dispenser in accordance with claim 4, further comprising a decorative shell surrounding said cam sleeve, and a decorative base surrounding said innerbody lower end.

6. A cosmetic dispenser in accordance with claim 5, further comprising a decorative cover frictionally fit over said cam sleeve decorative shell, and wherein locking of said cam sleeve and said innerbody together permits said cover to be removed from said decorative shell without providing a gap between said decorative shell and decorative base.

7. A cosmetic dispenser, comprising:

a tubular cam sleeve having a base, and upper and lower ends, and an inner wall and an outer wall, and an inner shoulder located on said inner wall of said cam sleeve at a position adjacent an upper end of said base, said cam sleeve base being generally unbroken and circular, and said cam sleeve having two internal helical tracks located 180 degrees apart and extending along a substantial length of the inner wall of said cam sleeve, said helical tracks having a lower end;

a tubular innerbody having upper and lower ends, said innerbody being fitted into said tubular cam sleeve and being provided with two longitudinal tracks extending through the wall of said innerbody along a substantial length of said innerbody, said longitudinal tracks having lower ends, said lower ends of said longitudinal tracks terminating at a level adjacent to a level of said lower ends of said cam sleeve helical tracks, and having a bevelled shoulder around a lower outer wall thereof located below said lower ends of said longitudinal tracks;

horizontal track segments provided in at least one of the group consisting of said lower ends of said helical tracks and said lower ends of said longitudinal tracks;

a generally cylindrical elevator cup for containing a cosmetic preparation, fitted into said innerbody and having two cam follower lugs located 180 degrees apart and having a sufficient length to extend through said longitudinal tracks to engage said helical tracks, said elevator cup being movable in an axial path by relative rotation of said innerbody and cam sleeve to extend and retract said elevator cup, whereby full retraction of said elevator cup causes said cam follower lugs to be received in and trapped by said horizontal track segments to lock said innerbody and cam sleeve together to prevent longitudinal sliding of said innerbody relative to said cam sleeve;

said cam sleeve and innerbody being capable of limited axial movement relative to each other when said cam follower lugs are not trapped by said horizontal track segments, said cam sleeve being movable by force applied to said elevator cup and transferred from said elevator cup to said cam sleeve through engagement of said cam follower lug in said helical track of said cam sleeve to move said cam sleeve downwardly to cause said cam sleeve inner shoulder to frictionally engage with said innerbody bevelled shoulder to prevent relative rotation of said innerbody and said cam sleeve.

8. A cosmetic dispenser in accordance with claim 7, further comprising a decorative shell surrounding said cam sleeve, and a decorative base surrounding said innerbody lower end.

9. A cosmetic dispenser in accordance with claim 8, further comprising a decorative cover frictionally fit over said cam sleeve decorative shell, and wherein locking of said cam sleeve and said innerbody together permits said cover to be removed from said decorative shell without providing a gap between said decorative shell and decorative base.

* * * * *